US009157440B2

(12) United States Patent
Kiesbauer et al.

(10) Patent No.: US 9,157,440 B2
(45) Date of Patent: Oct. 13, 2015

(54) METHOD AND SYSTEM FOR CONTROLLING A PROCESS FLUID STREAM AND POSITIONER

(75) Inventors: Joerg Kiesbauer, Eppertshausen (DE); Domagoj Vnucec, Mannheim (DE); Dirk Hoffmann, Offenbach (DE); Thomas Paulus, Frankenthal (DE); Manfred Oesterle, Frankenthal (DE)

(73) Assignees: Samson Aktiengesellschaft, Frankfurt (DE); KSB Aktiengesellschaft, Frankenthal (DE)

( * ) Notice: Subject to any disclaimer, the term of this patent is extended or adjusted under 35 U.S.C. 154(b) by 1164 days.

(21) Appl. No.: 12/977,343

(22) Filed: Dec. 23, 2010

(65) Prior Publication Data

US 2011/0146799 A1 Jun. 23, 2011

(30) Foreign Application Priority Data

Dec. 23, 2009 (DE) ..... 10 2009 060 262

(51) Int. Cl.
*F04D 15/00* (2006.01)

(52) U.S. Cl.
CPC ..... *F04D 15/0022* (2013.01); *F04D 15/0066* (2013.01); *Y10T 137/0318* (2015.04); *Y10T 137/85978* (2015.04)

(58) Field of Classification Search
CPC ..... F04D 15/0022; F04D 15/0066; Y10T 137/0318; Y10T 137/85978
USPC ..... 251/129.04; 137/2, 12; 417/20, 23, 26, 417/28
See application file for complete search history.

(56) References Cited

U.S. PATENT DOCUMENTS

| | | | | |
|---|---|---|---|---|
| 3,974,879 | A * | 8/1976 | Nelson et al. | 251/129.04 |
| 5,038,821 | A * | 8/1991 | Maget | 251/129.04 |
| 5,307,288 | A | 4/1994 | Haines | |
| 5,329,465 | A * | 7/1994 | Arcella et al. | 137/554 |
| 5,590,677 | A * | 1/1997 | Kuroda | 251/129.09 |
| 5,730,861 | A * | 3/1998 | Sterghos et al. | 137/554 |
| 6,257,833 | B1 * | 7/2001 | Bates | 417/4 |
| 6,592,099 | B2 * | 7/2003 | Yamamoto et al. | 251/129.04 |
| 6,616,121 | B2 * | 9/2003 | Asakura et al. | 251/129.04 |

(Continued)

FOREIGN PATENT DOCUMENTS

| | | | |
|---|---|---|---|
| BR | PI 0603403-9 | A | 8/2008 |
| DE | 102007009302 | A1 | 9/2007 |

(Continued)

*Primary Examiner* — John Bastianelli
(74) *Attorney, Agent, or Firm* — Schiff Hardin LLP

(57) ABSTRACT

In a method or system for controlling a process fluid stream within an industrial process plant, a pump is provided in series with a control valve having an associated positioner to control the fluid stream. A required fluid passage quantity for the process fluid stream is set by positioning the control valve with the positioner into a respective valve position and capturing an actual position of the valve. A physically sensible actual property value related to passage of the process fluid through the control valve is determined. The actual property value as well as the actual valve position are evaluated by an evaluation routine with respect to a predetermined optimization parameter specific to the valve with its associated positioner. If a deviation occurs from the optimization parameter, a pump drive value for the pump and control valve position drive value for the valve positioner are tuned to each other in such a way that the optimization parameter is approached.

30 Claims, 6 Drawing Sheets

(56) References Cited

U.S. PATENT DOCUMENTS

| | | | | |
|---|---|---|---|---|
| 7,163,380 | B2 * | 1/2007 | Jones | 417/44.1 |
| 7,178,783 | B2 * | 2/2007 | Tuin et al. | 251/129.04 |
| 7,401,624 | B2 * | 7/2008 | Heer | 137/554 |
| 7,925,385 | B2 | 4/2011 | Stavale et al. | |
| 2001/0054395 | A1 | 12/2001 | Stephan et al. | |
| 2002/0030170 | A1 * | 3/2002 | McKell et al. | 251/129.04 |
| 2006/0266966 | A1 * | 11/2006 | Karte et al. | 251/129.04 |
| 2008/0042087 | A1 * | 2/2008 | Pfaff | 251/129.04 |
| 2009/0277243 | A1 * | 11/2009 | Zhang et al. | 251/129.04 |
| 2010/0268389 | A1 | 10/2010 | Wurm | |

FOREIGN PATENT DOCUMENTS

| | | | |
|---|---|---|---|
| DE | 102007010768 | A1 | 9/2007 |
| DE | 10 2007 053 948 | | 5/2009 |
| EP | 0962847 | A1 | 12/1999 |
| EP | 1126178 | A2 | 8/2001 |

* cited by examiner

METHOD AND SYSTEM FOR CONTROLLING A PROCESS FLUID STREAM AND POSITIONER

BACKGROUND

The preferred embodiment relates to a method and a system for controlling a process fluid stream in an industrial process plant operating in the technical area of chemistry, petrol chemistry, gas processing, pharmaceutics or the production of food, cellulose, paper, glass, steel or cement or similar areas. In an industrial process plant process-engineering processes are running in which fluid streams relating to a main process are influenced continuously or discontinuously. For example, in large scale chemical plants, pharmaceutical plants, steel and cement producing plants, waste incineration plants, foundries, etc. process fluid streams are formed that are to be adjusted as required by the process and the operation in accordance with certain control parameters such as temperature or flow rate. In industrial process plants also raw materials can be extracted such as metal from ore. Therein the raw material for a process can itself be the result of a preceding process. The production of finished products or the recycling of raw materials from waste and garbage also belong to the technical area of process engineering.

For controlling a fluid stream in a line network of an industrial process plant it is generally known to employ field devices or positioners often designed as adjustable control valves. By means of a control valve the flow cross-section of a line can be adjusted in order to change the fluid stream according to the control parameters. As the positioning device of a process engineering industrial process plant is often located in environments at risk of explosion, the positioning device is actuated by means of a pneumatic drive controlled by a positioner with an current/pressure converter (I/P converter). The positioner receives external required positioning signals in order to position the positioning device according to the control parameters and thereby control the process fluid stream. Furthermore, the positioner receives actual position signals from a position sensor and contains its own control routines in order to produce a positioning signal for the pneumatic drive based on the desired required value and the measured position. A disadvantage of controlling a process fluid stream by means of a control valve is the control valve acts as a variable flow resistance and the narrower the flow cross-section limited by the control valve becomes, the larger becomes the pressure difference present at the positioning member and the larger the loss in flow rate to be tolerated. It results that each positioning device has a specific functional characteristic and thereby exhibits a specific control behavior. A particularly important control parameter is the so-called valve authority, which relates to the ability of the control valve to precisely control and adjust the desired process fluid stream and which for example can be defined by the ratio of the process fluid pressure difference at the positioning valve when flow is present and the pressure difference for minimum flow according to experience. When the pressure difference at the control valve becomes too small the ability to precisely control and adjust the flow disappears. Therefore, in order to provide a functional control it is necessary to assure a sufficient pressure difference at the control valve i.e. to assure that valve authority is present.

A pump is provided for producing the process fluid stream within the line network of the industrial process plant, wherein for reasons of costs and control efficiency the pump commonly provides a constant fluid pressure for flow generation. The drive value such as the rotation speed of the pump of an industrial process plant is generally not variable because influencing the process fluid stream by means of the pump in a fluid-stream-user-specific manner is difficult, in particular if several users of streams are arranged downstream of the pump at different line sections. In any aspect the control effort for a rotation-controlled pump would be very elaborate.

Recently there are development tendencies in the area of industrial process plants to completely replace control valves by a pump with rotation speed control individually adapted to the process consumer. For example, DE 10 2007 053 948 A1 discloses an installation for controlling a fluid stream in a heater, wherein instead of a control valve the pump of the industrial process installation is a motor-driven centrifugal pump adjustable according to demand.

However, as indicated above, it results that a control system adapted for individual process users where control valves are replaced by rotation speed control is—if possible at all—only feasible with an extremely high design and control effort and energy expenditure.

SUMMARY

It is an object to provide a method and an arrangement for controlling a process fluid stream enabling a simple, energy-efficient process fluid stream control, wherein wear of the functional and line elements of the control system is to be avoided.

In a method or system for controlling a process fluid stream within an industrial process plant, a pump is provided in series with a control valve having an associated positioner to control the fluid stream. A required fluid passage quantity for the process fluid stream is set by positioning the control valve with the positioner into a respective valve position and capturing an actual position of the valve. A physically sensible actual property value related to passage of the process fluid through the control valve is determined. The actual property value as well as the actual valve position are evaluated by an evaluation routine with respect to a predetermined optimization parameter specific to the valve with its associated positioner. If a deviation occurs from the optimization parameter, a pump drive value for the pump and control valve position drive value for the valve positioner are tuned to each other in such a way that the optimization parameter is approached.

DESCRIPTION OF THE PREFERRED EMBODIMENTS

Figure 1:
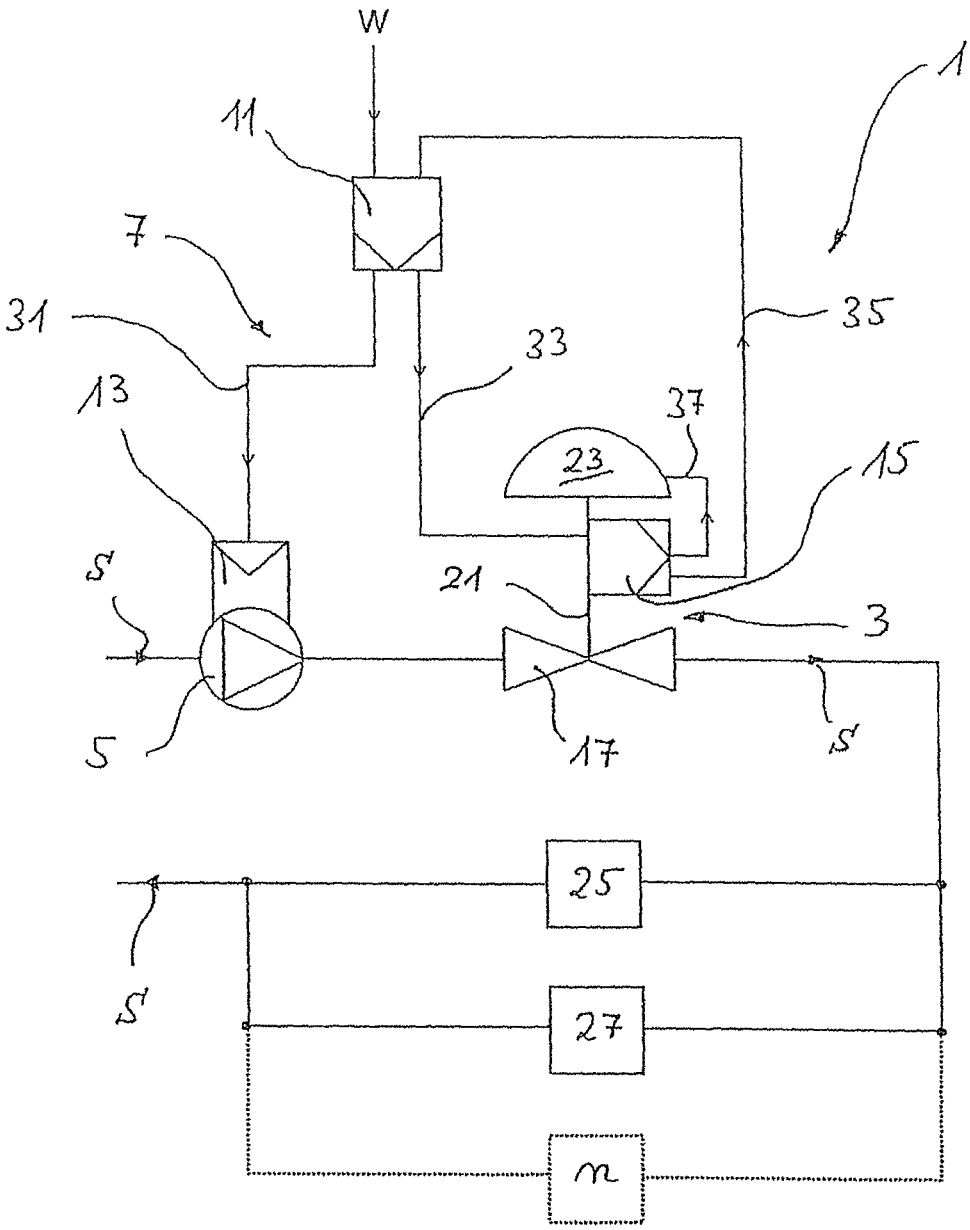
FIG. 1 is a block circuit diagram of an arrangement for controlling a process fluid stream in a first embodiment.

For purposes of promoting an understanding of principles of the invention, reference will now be made to preferred method/system embodiments/best mode illustrated in the drawings and specific language will be used to describe the same. It will nevertheless be understood that no limitation of the scope of the invention is thereby intended, and such alterations and further modifications in the illustrated methods/systems and such further applications of the principles of the invention as illustrated as would normally occur to one skilled in the art to which the invention relates are included.

According to the preferred embodiment, a method is provided for controlling a process fluid stream generated by a pump within an industrial process plant such as a chemical or petrochemical plant, a pasteurization plant, a brewery, a food production plant, a pharmaceutical plant, etc. A required passage quantity of the process fluid either provided by an internal control routine of a positioner or by a process control center is set by positioning a positioning device such as a control valve into a respective valve position by means of particularly adjusting a flow cross-section of the control valve according to the predetermined parameter. The actually present momentary valve position, that is in particular the flow cross-section at the positioning device, is captured, and also another physically sensible actual property value relating to a process fluid passage at the control valve is determined and/or sensed, which for example can be a position-related value affected by the process fluid stream control at the control valve, in particular a passage flow value. An evaluation routine evaluates the actual property value as well as the actual valve position with respect to a predetermined optimization parameter specific to the control valve, such as a valve authority, an optimized control activity of the control valve, an optimized energy efficiency, a minimized control valve throttling effect, an expected wear or a wear prediction. In case of a deviation from the optimization parameter specific to the positioning device, determined by the evaluation procedure, the drive value such as the pump rotation speed generating the process fluid stream and the position of the control valve, which can be arranged distally transverse, are tuned to each other in such a way that the optimization parameter is approached, and preferably the optimization parameter is actually adopted. According to the preferred embodiment, this tuning shall occur in such a way that the fluid passage quantity at the control valve, controlled according to the set fluid passage quantity and in particular equal to the set fluid passage quantity, is not altered.

According to the preferred embodiment, a functional dependency of the actual property value from the actual valve position shall be evaluated with respect to a predetermined optimization parameter specific to the control valve, wherein the optimization parameter shall be a physically sensible operational parameter of the control valve gained from experience regarding the operation of the control valve, the pump, and the technical process plant. It turned out that this operational parameter can be optimized if the actual valve position as well as a physically captured actual property value relating to this operational parameter is altered as a variable dimension.

The actual property value of the control system can be composed of different physical dimensions. The readjustment according to the preferred embodiment of the drive value and the position of the positioning device without altering the fluid passage quantity enables a reduction of the working level of a pump that may be working in an energy wasting manner with respect to a desired process fluid stream and consequently also excessively wears the control valve as a result of a too high pressure difference, wherein the process fluid stream remains unaffected with respect to the fluid passage quantity owing to the increase of the flow cross-section at the control valve. The preferred embodiment enables use of less energy for the operation of the pump. Furthermore, alternatively or in combination with energy-efficient control, it is possible to significantly reduce wear at the positioning device.

In a further development of the preferred embodiment it is distinguished between a first procedural step and a second procedural step. In the first procedural step the required fluid passage quantities at the control valve are achieved through respectively positioning the control valve by means of exclusively observing the requirements of the technical process plant. In the second procedural step the drive value of the pump as well as the valve position at the control valve are readjusted in such a way, that the optimization parameter is approached or adopted without essentially altering the fluid passage quantity adjusted in the first procedural step. The first and the second procedural step can be performed consecutively or also simultaneously depending on the previously set priority. In particular it should be noticed that the adjustment of the required fluid passage quantity and the tuning of the drive value and the valve position can be performed by separate control routines or also in unitary fashion.

In the preferred embodiment an analysis or evaluation routine with a permissible, limited optimization range is defined, wherein, in case that upon adjustment of the required fluid passage quantity the limits set by the permissible optimization parameter range are exceeded, the tuning of the drive value and of the valve position is performed in such a way that the optimization parameter range is reached without essentially altering the fluid passage quantity, controlled towards the fluid passage quantity required by the positioning device.

Preferably the optimization parameter or optimization parameter range is predefined by a default value determined from experience, in particular an upper and lower parameter limit. In the preferred embodiment, the actual property value is determined and defined by a sensible or measurable physical quantity that characterizes the flow properties of the process fluid at the control valve, such as the cavitational intensity. The optimization parameter assigned to the flow behavior of the process fluid can be for example an optimized service life of the positioning device through minimization of wear.

In the preferred embodiment, in case that the flow behaviour exceeds a predetermined critical state, the optimization, in particular the readjustment and/or the tuning of the drive value and the valve position of the positioning device is performed with respect to the optimization parameter.

In a further development it should be clear that the condition according to the preferred embodiment, specifying that the fluid passage quantity controlled towards the required quantity is to be maintained unaltered when the readjustment and/or tuning of the actual valve position accompanies the adjustment of the actual drive value, should be lifted if a critical emergency situation, in particular of the technical process plant, arises. For example in case of a critical deviation from the optimization parameter specific to the control valve, in particular subsequent to the tuning or readjustment according to the preferred embodiment, the drive value as well as the valve position are emergency-controlled in such a way that the fluid passage quantity controlled with respect to the required quantity is altered in order to achieve at least an uncritical operating state, in particular an uncritical deviation from the optimization parameter. Once the uncritical operation of the technical process plant is achieved, an adjustment of the valve position as well as the drive value functionally optimized with respect to the optimization parameter can be performed once more. In the preferred embodiment, the actual property value is defined and sensed through the pressure difference of the process fluid stream at the control valve, in particular between its input and its output. Therein the optimization parameter assignable to the pressure difference can be the valve authority of the control valve. The higher the pressure difference of the process fluid stream at the control valve the higher is the wear to be expected there. Also the expected wear can be regarded as an optimization parameter. Thus, the method according to the preferred embodiment enables to maintain the primary objective of the desired fluid passage quantity wherein heed is paid to a precise control of the control valve (valve authority) and to its low wear through the tuning according to the preferred embodiment.

In case that the pressure difference of the process fluid stream at the control valve is too low or too high with respect to the optimization parameter, tuning is performed by adjusting the drive value, in particular raising or lowering, and altering of the valve position, in particular closing or opening, is performed in such a way that the pressure difference of the process fluid stream at the control valve is optimized with respect to its optimization parameter.

In the preferred embodiment the actual property value is determined via an in particular direct measurement of the actual fluid passage quantity in particular via a pair of sensors upstream and downstream of the control valve. The optimization parameter assigned to the fluid passage quantity can be an expected occurrence of wear of the control valve.

In a further development of the preferred embodiment, the actual property value is the supply pressure of a pneumatic drive acting on the control valve, in particular a value ratio between a positioning path of the pneumatic drive or of the control valve and the supply pressure. Therein the optimization parameter assigned to the supply pressure can be the energy efficiency concerning the pneumatic drive and/or the expected occurrence of wear at the control valve.

In a further development of the preferred embodiment the actual property value is an acceleration value captured at the positioning device such as an acoustic signal. Therein the optimization parameter assigned to the acceleration value can be the state of wear present at the control valve.

In the preferred embodiment of the invention the optimization parameter specific to the positioning device is determined by the valve authority. The valve authority describes the ability of the valve to interfere with the process in a sufficiently precisely controlling manner and to alter the passage flow by altering the valve position. The valve authority is defined by the ratio of the pressure difference of the control valve during normal passage flow and the pressure difference during minimum permissible passage flow. Therefore the valve authority as an optimization parameter requires that the pressure difference at the control valve does not become too small. The optimization parameter also limits the wear because wearing effects typically decrease with lower pressure difference.

In contrast to the latter, energy efficiency as an optimization parameter acts towards a lowest possible pressure level at the pump output. However, the possibilities of adjusting the pump rotation speed towards lower values are limited because installation pumps only have a limited rotation speed range as a working range.

According to the afore-mentioned examples, the different observation and optimization parameters, depending on the mode of operation and emerging effects, lead to a different alteration of the pump rotation speed, in order to assure a precise control, a damage-free operation of the control valve as well as high energy efficiency.

Each position device can be allocated an individual valve characteristic. The latter can be predetermined from empirical values and the compliance with defined manufacturing tolerances. If then according to the operation it is determined that the auxiliary set value of the control is not in an optimum relation with respect to the determined position of the positioning device, the desired pressure difference at the positioning device can be adjusted by means of the readjustment of the drive value and the position of the positioning device without affecting the specified fluid passage, so that optimum operational conditions are present at the positioning device with respect of the used optimization parameter.

The preferred embodiment also relates to an arrangement for controlling a process fluid stream in an industrial process plant as described above. The arrangement according to the preferred embodiment comprises a pump for generating the process fluid stream and a control valve downstream of the pump for adjusting a fluid passage cross-section. Furthermore, the arrangement has a fluid passage quantity control according to which a valve position can be adjusted for obtaining a required fluid passage quantity and which comprises a means for capturing the actual valve position. According to the preferred embodiment the pump is designed for adjusting the drive value such as its rotation speed. Furthermore, the fluid passage quantity control has a means for capturing at least one actual property value relating to a process fluid passage at the positioning device. According to the preferred embodiment the fluid passage quantity control evaluates the respective actual property value as well as the actual valve position with respect to a predetermined optimization parameter, particularly specific to the control valve, such as a valve authority, an optimized control activity of a control valve, an optimized energy efficiency particularly with regard to the pump, a lowest possible control valve throttling, etc. In case of a non-negligible deviation from the optimization parameter specific to the positioning device, the fluid passage quantity control is designed to tune the drive value and the valve position with respect to each other in such a way that the optimization parameter is essentially approached, in particular that the optimization parameter is adopted. Therein the fluid passage quantity controlled with respect to the required quantity shall not be altered.

In the preferred embodiment of the invention the control unit comprises a positioner that outputs a positioning signal to a positioning drive of the positioning device, a drive-value controller outputting the drive value control signal to the pump, and a main process controller connected in a signal-transmitting manner to the positioner and to the drive value controller, the main process controller receiving a required fluid passage quantity signal from a process control centre of the industrial process plant, a signal relating to the captured actual property value as well as a signal relating to the captured actual valve position, performing the evaluation with respect to the optimization parameter and outputting the drive value readjustment signal to the pump and a position control signal to the positioner.

Preferably the means for capturing the actual property value is a fluid passage measurement device to which the fluid passage control, particularly the positioner or the main process controller are connected in a signal-transmitting manner in order to receive a signal relating to the fluid passage quantity.

In the preferred embodiment of the invention the positioner is attached to the control valve wherein the drive value controller is attached to the pump, and the main process controller is positioned distally to the positioner and the drive value controller.

In the preferred embodiment of the invention the positioner is connected to the drive value controller in a signal-transmitting manner in order to receive the drive value signal, wherein the positioner has as a means for capturing an actual property value a means for determining the wear load of the control valve. The positioner outputs a first readjustment signal for altering the valve position and a second readjustment signal for altering the drive value directly to the drive value controller while tuning the readjustment signals so that the wear load is reduced while the fluid passage quantity at the control valve is maintained constant.

Preferably a signal transmission unit is installed between the positioner and the main process controller, which unit is designed as a digital field bus with bi-directional communication technology.

In a further development of the preferred embodiment an acceleration sensor is disposed in the vicinity of a valve member limiting the passage cross-section for the process fluid in order to determine acceleration values at the valve member as a actual property value. The acceleration values are issued to the positioner in order to diagnose the degree of wear.

It shall be understood that the arrangement according to the preferred embodiment is designed for realizing the control method according to the preferred embodiment.

Finally, the preferred embodiment relates to a positioner for a positioning device such as a control valve for adjusting a process fluid stream generated by a pump in an industrial process plant as defined above.

The positioner according to the preferred embodiment has at least one signal input for receiving an actual position signal from which the actual position of the control valve can at least be derived, for receiving a desired required fluid passage quantity signal at the control valve and for receiving an actual property value relating to the process fluid stream at the control valve. Further, the positioner according to the preferred embodiment has a signal output for outputting a position control signal. Furthermore, the positioner has an electronic evaluation unit such a micro computer. According to the preferred embodiment, the positioner is designed for receiving a captured actual drive value such as an actual pump rotation speed. Furthermore, the evaluation means unit a control signal pair based on the actual property value, the actual position signal and a stored optimization parameter such as an optimized control activity of the control valve, an optimized energy efficiency, a lowest possible throttling of the control valve or a valve authority, in order to tune and to adjust to each other the drive value of the pump and the valve position. The positioner can be coupled to the pump in a signal-transmitting manner for outputting the control signal so that while essentially keeping constant the fluid passage quantity that is adjusted with respect to the required fluid passage quantity, the position of the control valve as well as the drive value of the pump are adjusted with respect to the optimization parameter.

In a further development of the preferred embodiment the positioner performs a wear load diagnosis at the control valve and, if applicable, outputs the drive value control signal to the pump in order to adjust, in particular to raise or lower the drive value for wear load reduction.

Preferably the capturing system for the actual property value is a fluid passage measurement device. In a preferred embodiment of the invention the main process controller is disposed in the vicinity of the positioner. Therein the main process controller can be integrated into the housing. Furthermore, the main process controller can also be part of the positioner.

It shall be understood that the positioner according to the preferred embodiment can operate according to the features of the method according to the preferred embodiment.

Further characteristics, advantages and features of the preferred embodiment will become clear through the following description of preferred embodiment of the process stream control arrangement in conjunction with the following drawing figure.

In FIG. 1 the arrangement for controlling a process fluid stream in an industrial process plant for application in process engineering is generally given the reference numeral 1. Plants of the process industry are for example chemical or petrochemical plants, pharmaceutical plants, gas processing plants, plants for processing food, cellulose, paper, glass, steel, and plants for cement production.

The arrangement according to the preferred embodiment essentially is comprised of three main components, that is a field device designed as a positioning device 3 comprising a control valve 17, a pump 5 for generating the process fluid stream indicated by the arrows s, and a control system 7 comprised of a main process controller 11, a rotation speed controller 13 attached to the pump 5, and a positioner 15 disposed at the positioning device 3.

The process fluid stream s goes from the pump 5 to the control valve 17 of device 17 that is actuated via a positioning rod 21 of a pneumatic drive 23. Via separate line paths 25, 27, n the process fluid stream s gets from the control valve 17 to different users.

The main process controller 11 is connected to the rotation speed controller 13 in a signal-transmitting manner via a signal line 31. Furthermore, the main process controller 11 is connected to the positioner 15 in a signal-transmitting manner via a signal line 33. The positioner 15 transmits signals relating to the process fluid stream as well as to operation of the positioning device 3 via a signal line 35 to the main process controller 11. The positioner 15 has a signal input for receiving a positioning signal from the main process controller 11 and an electronic signal output for transmitting certain functional operating signals to the main process controller 11. Furthermore, the positioner 15 has a pneumatic output via which an I/P-converter (not represented) is connected with the pneumatic drive 23. A pneumatic line 37 is provided for this purpose.

A characteristic of the control method according to the preferred embodiment is that primarily not the process fluid stream s is adjusted, but the work status of the positioning device 3, in particular of the control valve 17, is optimized with respect to the output of the pump 5 so that less energy is required in order to maintain the process fluid stream s and, in particular, to reduce wear-related phenomena at the positioning device 3.

In the control method according to the preferred embodiment the main process controller 11 receives a required fluid passage quantity signal w from a control center (not represented), which quantity signal is evaluated in the main process controller 11 according to a main control routine by transmitting a rotation speed signal to the rotation speed controller 13 via the signal transmission line 31 in order to drive the pump. At the same time a positioning signal is fed via the signal line 33 to the positioner 15 which positions the control valve 17 accordingly.

A characteristic of the control method with a readjustment routine according to the preferred embodiment is that an auxiliary positioning value or optimization parameter of the control system is determined at the positioning device 3, which for example can be defined by the pressure difference at the valve 17, a proportion between positioning path and pneumatic working pressure of the pneumatic drive 23, by direct capture of the fluid passage quantity or by capturing of the acceleration oscillation behavior of the positioning device 3.

The positioner 15 transmits the auxiliary positioning value of the control system as well as the actual position of the control valve 17 to the main process controller 11 via the signal line 35.

Thus, the auxiliary positioning value of the control, the actual position of the control valve 17 as well as the rotation speed of the pump 5 are present at the main process controller 11. The main process controller has a readjustment routine that is designed for performing an evaluation by means of analysing the above listed values with respect to a previously stored and predetermined optimization parameter specific to the positioning device. The optimization parameter is an evaluation parameter that can be different for each positioning device. For example, the optimization parameter is determined by the control activity of the positioning device, an optimized energy efficiency, the minimization of wear at the positioning device or a lowest possible positioning device throttling effect for a given process fluid stream.

If accordingly the main process controller 11 realizes that the pressure difference at the control valve 17 is too large for the achievement of the desired required fluid passage quantity w, and/or an unnecessarily large wear is to be expected at the control valve 17, the main process controller 11 initiates a readjustment.

The readjustment comprises, with approximate maintenance of the desired process fluid stream s according to the required fluid passage quantity value w, a downward controlling of the rotation speed via the rotation speed controller 13 while at the same time the passage cross-section of the control valve 17 is enlarged. In this way an excessive pressure difference at the control valve 17 and thus an excessive wear can be prevented. Furthermore, the energy balance of the process fluid stream control is improved as the energy expenditure of the pump 5 can be considerably reduced resulting from lowering the throttling effect of the control valve 17.

Figure 2:
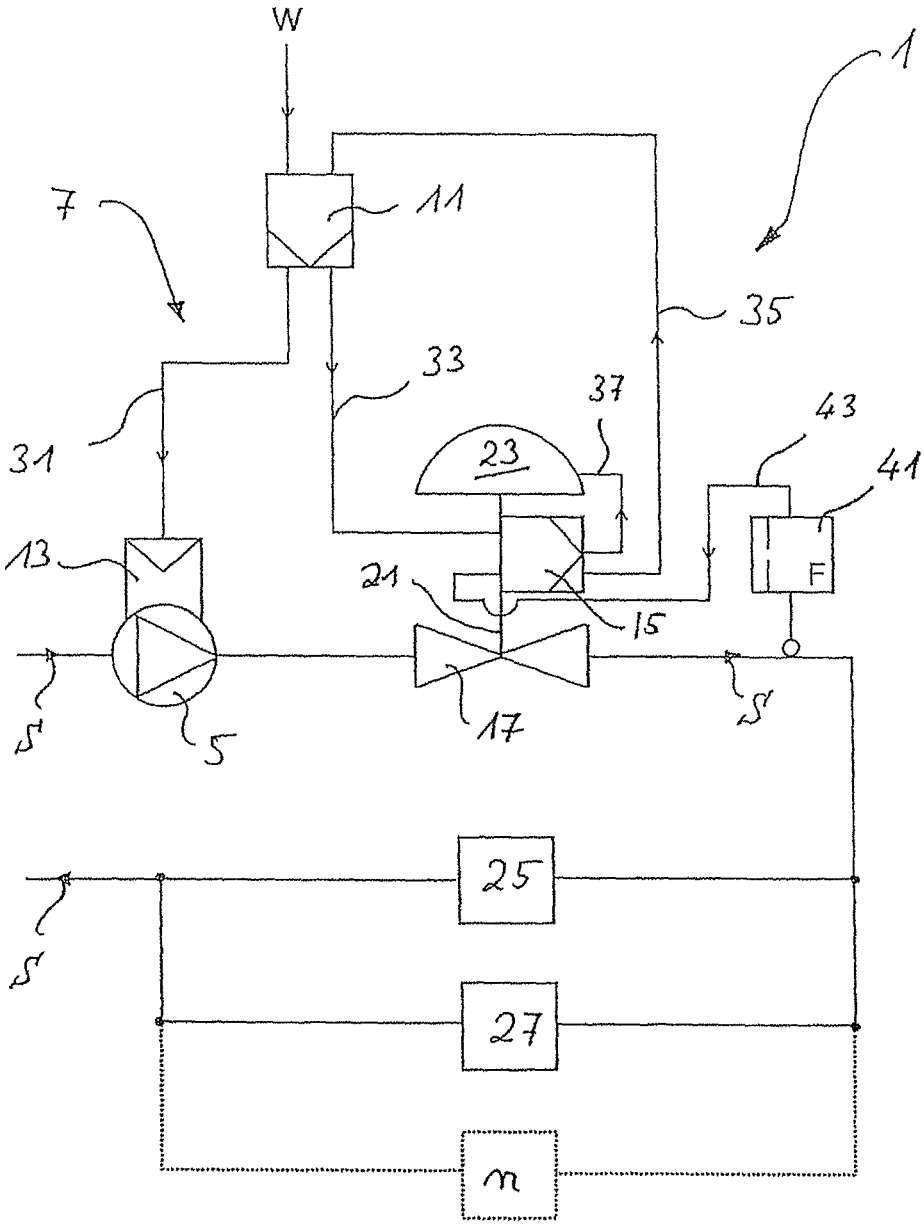
FIG. 2 is a block circuit diagram of an arrangement for controlling a process fluid stream in a second embodiment.

The embodiment according to FIG. 2 is distinguished from the arrangement according to FIG. 1 in that a fluid passage sensor 41 is directly capturing the fluid passage quantity of the process fluid stream, wherein the actual fluid passage quantity signal is communicated via a signal line 43 to the positioner 15.

The positioner 15 transmits the actual fluid passage quantity signal of the fluid passage quantity sensor 41 to the main process controller 11 via the signal line 35. It shall be understood that the fluid passage quantity measurement can also be performed without direct sensing of the fluid passage at the positioning device 3. For example it is possible to capture the fluid passage indirectly via the above mentioned proportion between positioning path and supply pressure of the pneumatic drive.

The further description of elements that are similar or identical in FIG. 2 compared to FIG. 1 is omitted if they have the same reference numerals because the remaining aspects of the arrangement in FIG. 2 are identical to the arrangement according to FIG. 1.

Figure 3:
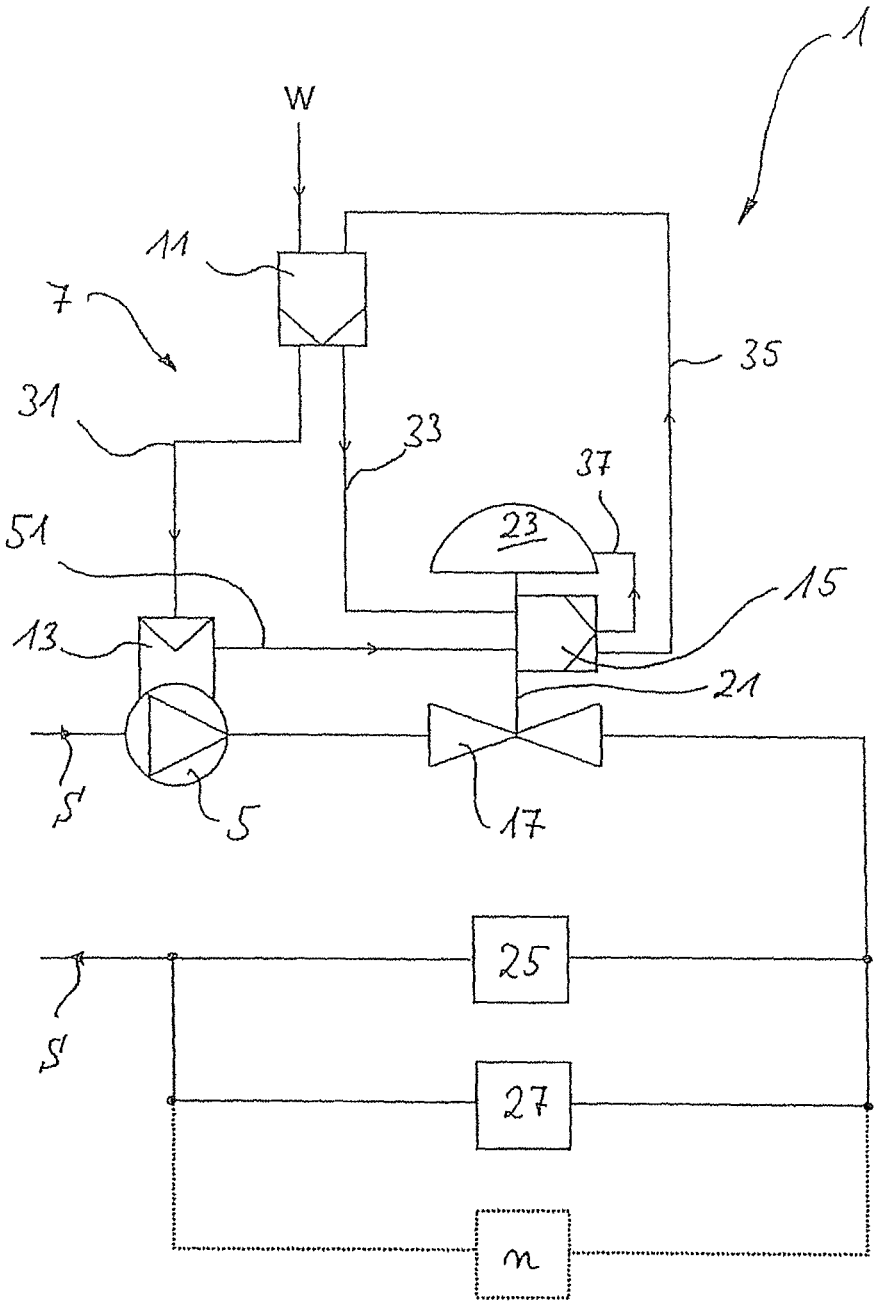
FIG. 3 is a block circuit diagram of an arrangement for controlling a process fluid stream in a third embodiment.

The arrangement according to FIG. 3 is distinguished from that in FIG. 1 in that a direct signal line 51 is provided between the rotation speed controller 13 and the positioner 15. For better readability of the Figure description, same or similar components of the arrangement in FIG. 3 are given the same reference numerals.

Via the direct signal line 51 the actual rotation speed signal of the rotation speed controller 13 can be directly transmitted to the positioner 15. This signal enables the positioner 15 to perform a diagnosis with respect to wear at the control valve 17. If the positioner 15 diagnoses a larger wear behavior at the control valve 17, a respective signal can be fed to the main process controller 11 which thereupon alters the pump rotation speed as well as the position of the control valve 17 without affecting the process fluid stream s according to the control method of the preferred embodiment.

It shall be understood that the positioner can also directly drive the rotation speed controller 13 (without the detour via the main process controller 11) in order to lower the rotation speed in a wear-reducing manner.

Figure 4:
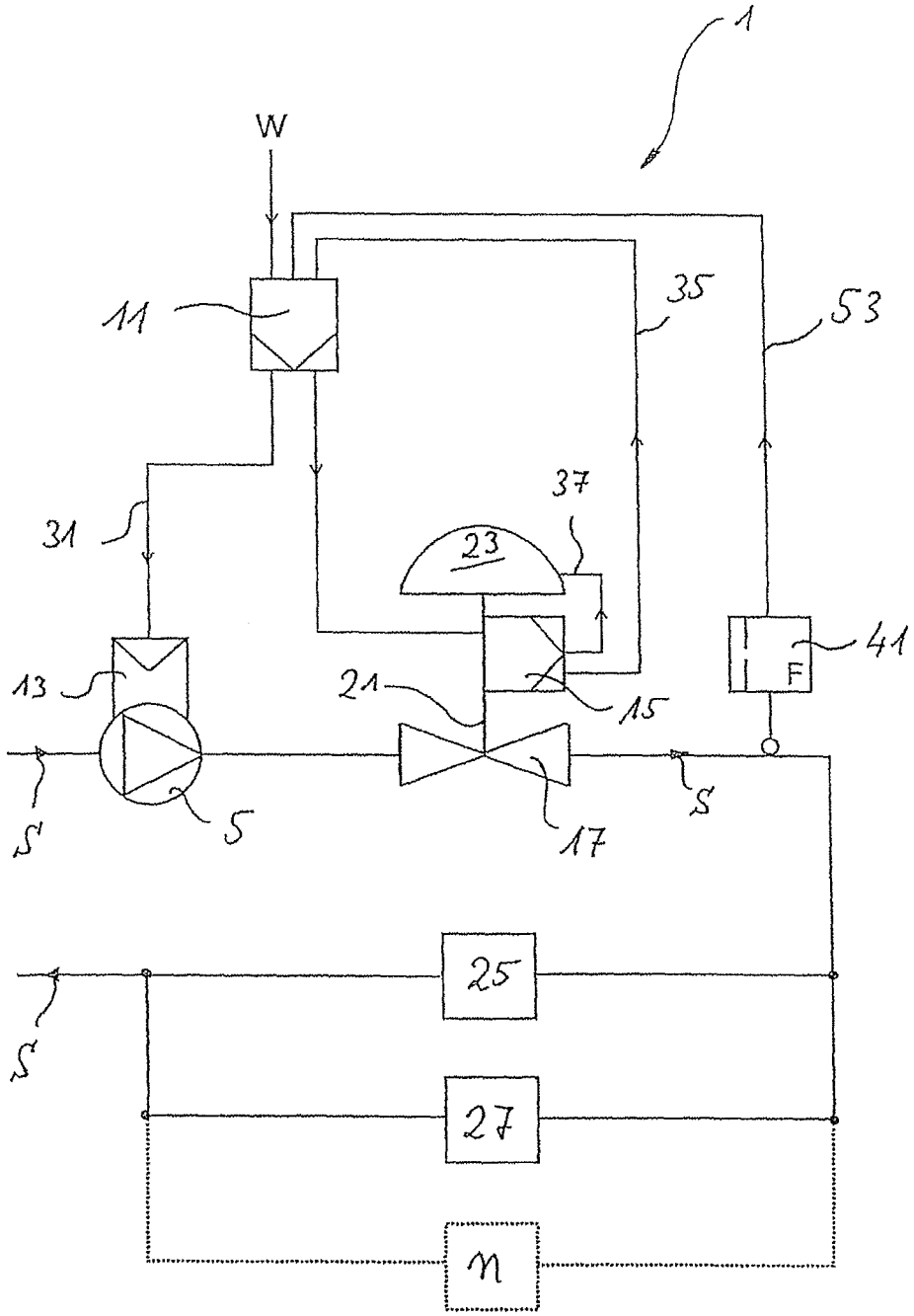
FIG. 4 is a block circuit diagram of an arrangement for controlling a process fluid stream in a forth embodiment.

The arrangement according to FIG. 4 represents a variation of the one according to FIG. 2 insofar as the fluid passage sensor 41 is not coupled via the positioner 15 for the purpose of diagnosis, but directly with the main process controller 11, which can also perform the diagnosis concerning wear of the control valve 17. In this way the energy consumption of the positioner 15 can be reduced, which can possibly be advantageous in order to assure an energy supply being kept low owing to the risk of explosion. A further signal line 53 is provided for direct communication between the fluid passage quantity sensor 41 and the main process controller 11.

For better readability of the Figure descriptions, identical and similar components are given identical reference numerals in FIGS. 2 and 4.

Figure 5:
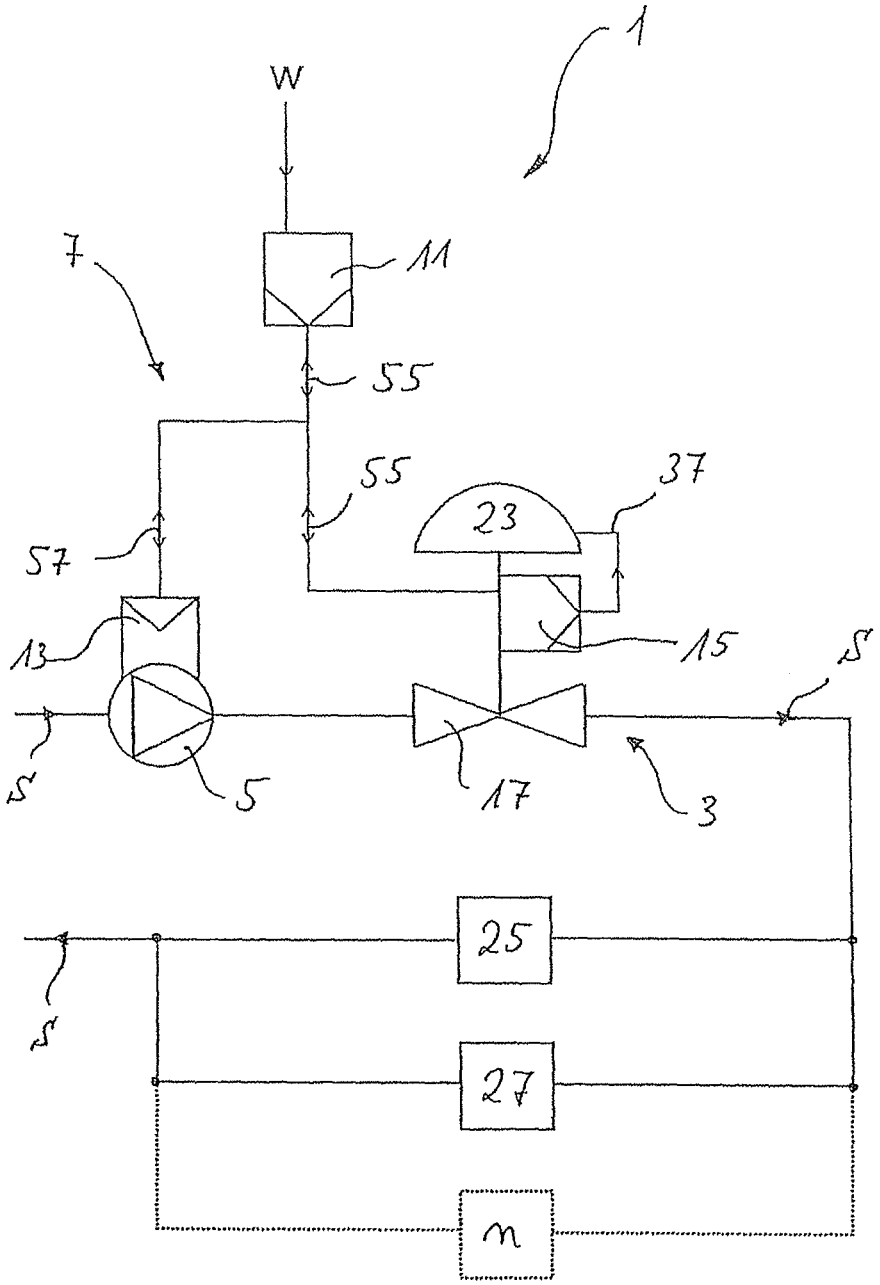
FIG. 5 is a block circuit diagram of an arrangement for controlling a process fluid stream in a fifth embodiment.

The arrangement according to FIG. 5 comprises a digital field bus for signal transmission between the main process controller 11 and the positioner 15 as well as the rotation speed controller 13, for example a Foundation-Fieldbus or Profibus enabling a bi-directional communication between the controllers, which is indicated by the double arrows 55, 57.

It shall be understood that alternatively to the shown signal transmission a communication via wireless signal is also possible.

For better readability the same reference numerals are used for the arrangements in FIGS. 1 and 5 for identical and similar components.

Figure 6:
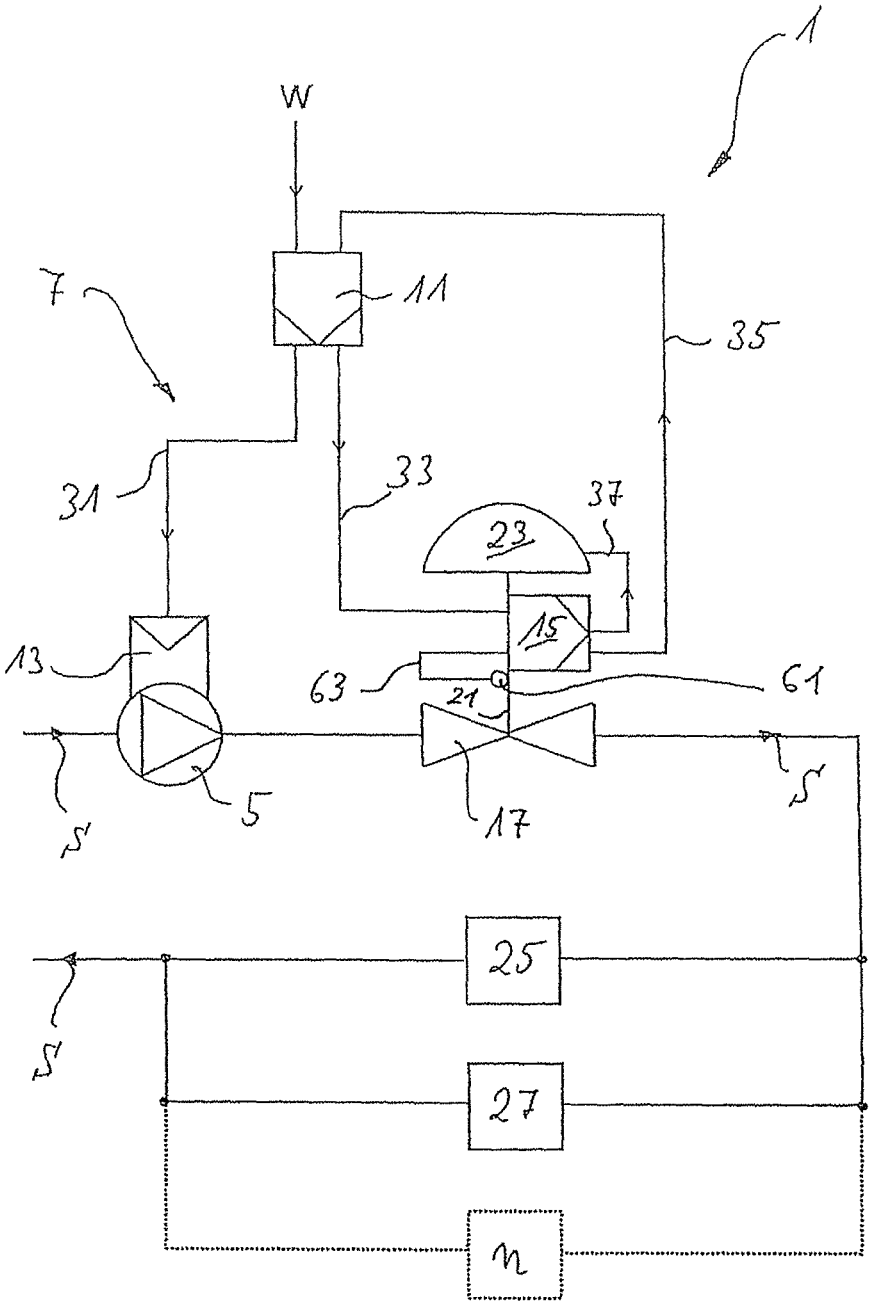
FIG. 6 is a block circuit diagram of an arrangement for controlling a process fluid stream in a sixth embodiment.

The arrangement according to FIG. 6 is distinguished from the one according to FIG. 1 in that an acceleration sensor 61 is disposed at the control valve, in particular at the positioning rod 21 of the positioning device 3, the acceleration sensor generating measured acceleration values of the positioning device 3. The signals of the acceleration values are fed to the positioner 15 via the line 63.

The positioner 15 can determine the state of wear of the control valve 17 based on empirical values and evaluation values. Based on the determined state of wear, finally the position of the control valve 17 as well as the rotation speed of the pump 5 can be adjusted in an optimum way with respect to wear and energy consumption.

In a further embodiment preferred embodiment—not represented—the main process controller is disposed proximate to the positioner or integrated into the housing of the positioner. Positioner and main process controller thereby form a unit disposed at the positioning device.

For better legibility the same reference numerals are used for identical and similar components of the arrangements in FIGS. 1 and 6.

Although preferred exemplary method/device embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A method for controlling a process fluid stream within an industrial process plant, comprising the steps of:

providing a pump in series with a control valve having an associated positioner to control said fluid stream;

setting a required fluid passage quantity for said process fluid stream by positioning said control valve with said positioner into a respective valve position and capturing an actual position of said valve;

determining a physically sensible actual property value related to passage of the process fluid through the control valve;

evaluating the actual property value as well as the actual valve position by an evaluation routine with respect to a predetermined optimization parameter specific to the valve with the associated positioner; and if a deviation occurs from the optimization parameter, tuning a pump drive value for said pump and a control valve position drive value for said valve positioner to each other in such a way that the optimization parameter is approached without substantially altering a fluid passage quantity through the valve controlled according to said required fluid passage quantity by slowing a speed of the pump combined with opening the control valve further or increasing a speed of the pump combined with closing the control valve further.

2. The method of claim 1 wherein the industrial process plant comprises at least one of a chemical plant, a petrochemical plant, a pasteurization plant, a brewery, a food production plant, and a pharmaceutical plant.

3. The method of claim 1 wherein said predetermined optimization parameter specific to the control valve with its associated positioner comprises at least one of a valve authority, an optimization control activity of the control valve, an optimized energy efficiency, and a minimized control valve throttling effect.

4. The method according to claim 1 wherein in a first step the required fluid passage quantity at the control valve is achieved through respectively positioning the control valve, and in a second step the drive value of the pump as well as the valve position drive value for the positioner associated with the control valve are readjusted in such a way that the optimization parameter is approached.

5. The method according to claim 1 wherein said evaluation routine has a permissible, limited optimization parameter range predefined, wherein, in case that upon adjustment of the required fluid passage quantity the limits set by the permissible optimization parameter range are exceeded, the tuning of the pump drive value and of the control valve position drive value is performed in such a way that the optimization parameter range is approached.

6. The method according to claim 5 wherein the optimization parameter range is predefined by an upper and lower parameter limit determined from experience.

7. The method according to claim 1 wherein the actual property value pertains to a sensible or measurable physical quantity that characterizes flow properties of the process fluid at the control valve comprising cavitational intensity, the optimization parameter assigned to the flow behavior of the process fluid being an optimized energy efficiency, in view of an energy balance of the pump and/or the control valve.

8. The method according to claim 7 wherein in case that flow behavior exceeds a predetermined critical state, the optimization, comprising readjustment of the pump drive value and the valve position drive value, is performed.

9. The method according to claim 1 wherein in case of a critical deviation from the optimization parameter subsequent to the tuning, the pump drive value as well as the valve position drive value are emergency-controlled in such a way that a fluid passage quantity controlled with respect to the required quantity is altered in order to achieve at least an uncritical deviation from the optimization parameter.

10. The method according to claim 1 wherein the actual property value is a pressure difference of the process fluid stream at the control valve between an input and an output of the control valve wherein the optimization parameter assigned to the pressure difference pertains to a valve authority of the control valve.

11. The method according to claim 10 wherein in case that the pressure difference of the process fluid stream at the control valve is too low or too high with respect to the optimization parameter, tuning is performed by adjusting the position drive value to be raised or lowered to alter the valve position by closing or opening, and this is performed in such a way that the pressure difference of the process fluid stream at the control valve is optimized with respect to said optimization parameter.

12. The method according to claim 1 wherein the actual property value is determined via a direct measurement of actual fluid passage quantity via sensors upstream and/or downstream of the control valve, wherein the optimization parameter is an expected occurrence of wear of the control valve.

13. The method according to claim 1 wherein the actual property value is a supply pressure of a pneumatic drive acting on the control valve, and is a value ratio between a positioning path of the control valve and the supply pressure, wherein the optimization parameter assigned to the supply pressure relates to an energy efficiency of the pump.

14. The method according to claim 1 wherein the actual property value comprises an acceleration value captured at the control valve which is an acoustic signal, and wherein the optimization parameter assigned to the acceleration value comprises a state of wear present at the control valve.

15. A system for controlling a process fluid stream within an industrial process plant, comprising:

a pump in series with a control valve having an associated positioner to control said fluid stream;

said positioner setting a required fluid passage quantity for said process fluid stream by positioning said control valve into a respective valve position, said positioner capturing an actual position of said valve;

an actual property value sensor determining a physically sensible actual property value related to passage of the process fluid through the control valve;

a control system for evaluating the actual property value as well as the actual valve position by an evaluation routine with respect to a predetermined optimization parameter specific to the valve with the associated positioner; and said control system, if a deviation occurs from the optimization parameter, tuning a pump drive value for said pump and a control valve position drive value for said valve positioner to each other in such a way that the optimization parameter is approached without substantially altering a fluid passage quantity through the valve controlled according to said required fluid passage quantity by slowing a speed of the pump combined with opening the control valve further or increasing a speed of the pump combined with closing the control valve further.

16. The system of claim 15 when said industrial process plant comprises at least one of a chemical plant, a petrochemical plant, a pasteurization plant, a brewery, a food production plant, and a pharmaceutical plant.

17. The system of claim 15 wherein said predetermined optimization parameter comprises at least one of a valve authority, an optimized control activity of the control valve, an optimized energy efficiency, and a lowest possible control valve throttling effect.

18. The system according to claim 15 wherein said positioner outputs a positioning signal to a positioning drive for said positioner, said control system outputting the pump drive value to the pump and the control valve position drive value to the positioner, the control system receiving said required fluid passage quantity from a process control center, the actual property value, and the captured actual valve position, said control system performing the evaluation with respect to the optimization parameter and outputting said pump drive value to the pump and said control valve position drive value to said positioner.

19. The system according to claim 15 wherein the actual property value sensor comprises a fluid passage measurement device connected to said control system.

20. The system according to claim 15 wherein the control system comprises a process controller.

21. The system according to claim 15 wherein said actual property value sensor being useful for determining a wear load of the control valve, the positioner outputting a first readjustment signal for altering the valve position and a second readjustment signal for altering the valve position drive value directly to the control system so that the wear load is reduced while fluid passage quantity at the control valve is maintained substantially constant.

22. The system according to claim 15 wherein a signal transmission unit is installed between the positioner and control system, said transmission unit being designed as a digital field bus with bi-directional communication technology.

23. The system according to claim 15 wherein an acceleration sensor is disposed in a vicinity of a valve member of the control valve limiting a passage cross section for the process fluid in order to determine acceleration values at the valve member as said actual property value, said acceleration values being sent to the positioner for diagnosing a degree of wear.

24. A positioning system for controlling a process fluid stream within an industrial process plant wherein a pump is provided in series with a control valve, comprising:

a positioner associated with said control valve;

said positioner setting a required fluid passage quantity for said process fluid stream by positioning said control valve into a respective valve position, said positioner capturing an actual position of said valve;

an actual property value sensor determining a physically sensible actual property value related to passage of the process fluid through the control valve;

a control system for evaluating the actual property value as well as the actual valve position by an evaluation routine with respect to a predetermined optimization parameter specific to the valve with the associated positioner; and said control system, if a deviation occurs from the optimization parameter, tuning a pump drive value for said pump and a control valve position drive value for said valve positioner to each other in such a way that the optimization parameter is approached without substantially altering a fluid passage quantity through the valve controlled according to said required fluid passage quantity by slowing a speed of the pump combined with opening the control valve further or increasing a speed of the pump combined with closing the control valve further.

25. The positioning system of claim 24 wherein said industrial process plant comprises at least one of a chemical plant, a petrochemical plant, a pasteurization plant, a brewery, a food production plant, and a pharmaceutical plant.

26. The positioning system of claim 24 wherein said stored optimization parameter comprises at least one of a valve authority, an optimized control activity of the control valve, an optimized energy efficiency, and a lowest possible control valve throttling.

27. The positioning system according to claim 24 wherein the control system performs a wear load diagnosis at the control valve and outputs the pump drive value to the pump in order to adjust for wear load reduction.

28. The positioning system according to claim 24 wherein the actual property value sensor comprises a fluid passage measurement device.

29. The positioning system according to claim 24 wherein said control system comprises a main process controller disposed in a vicinity of the valve positioner.

30. The positioning system according to claim 29 wherein the main process controller is integrated into a housing of the valve positioner.

* * * * *